United States Patent [19]

Rogers

[11] 3,988,912

[45] Nov. 2, 1976

[54] LOCKING DEVICES

[75] Inventor: Wilfrid David Rogers, Solihull, England

[73] Assignee: Wilmot-Breeden Ltd., Birmingham, England

[22] Filed: Mar. 10, 1976

[21] Appl. No.: 665,565

[52] U.S. Cl. ..... 70/364 R; 70/375

[51] Int. Cl.[2] ..... E05B 9/04

[58] Field of Search ..... 70/362, 364 R, 372, 70/375

[56] References Cited

UNITED STATES PATENTS

| | | | |
|---|---|---|---|
| 1,644,092 | 10/1927 | Shinn | 70/364 R |
| 2,016,602 | 10/1935 | Jacobi | 70/375 X |
| 3,702,553 | 11/1972 | Nolin | 70/375 |

FOREIGN PATENTS OR APPLICATIONS

| | | | |
|---|---|---|---|
| 497,699 | 11/1953 | Canada | 70/364 R |

*Primary Examiner*—Robert L. Wolfe

*Attorney, Agent, or Firm*—Young & Thompson

[57] ABSTRACT

The plug of a key-operated locking device is formed in two parts, namely an outer housing which is formed with slots to receive springs which act on tumblers of the device and an inner matrix formed with slots to receive the tumblers. The two parts are locked together by, for example, one of the staking bars normally used as abutment members for the tumbler springs.

6 Claims, 4 Drawing Figures

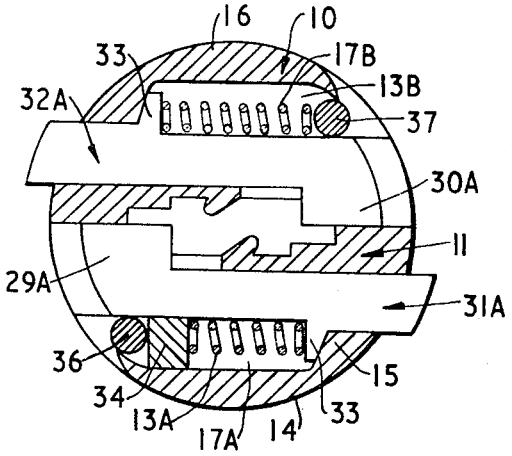
-FIG.1-
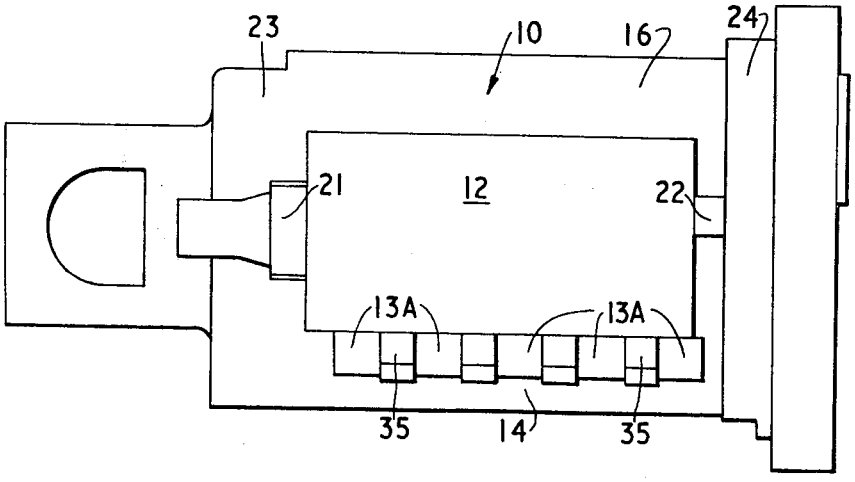
-FIG.2-

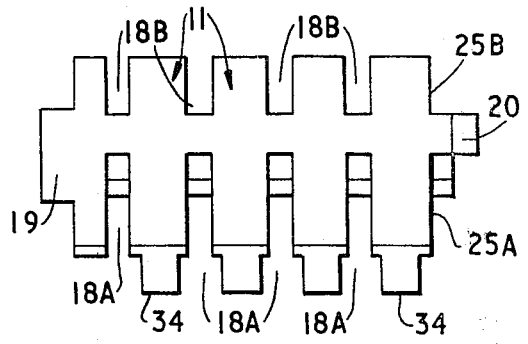
-FIG. 3-
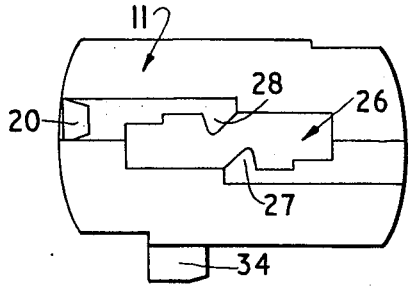
-FIG. 4-

LOCKING DEVICES

FIELD OF THE INVENTION

This invention relates to key-operated locking devices of the kind including a tumbler-containing portion (hereinafter referred to as a "lock plug" but occasionally referred to in the trade as a "barrel") which can be turned by means of the appropriate key within a housing which is hereinafter referred to as the "lock cylinder." The tumblers normally project from the plug into locking engagement with the cylinder to prevent rotation of the plug relative to the cylinder but are retracted into the plug by the key as the latter is inserted.

BACKGROUND OF THE INVENTION

In one known form of locking device of the above kind, the plug has a key-receiving slot for a double-entry edge-profiled key, the tumblers being arranged in two separate banks respectively positioned at opposite sides of the slot, the tumblers in the two banks operating independently and thereby providing the same security as an equal number of tumblers arranged in a single row extending axially of the plug in the usual manner, the edge profile of the key being common to both banks of tumblers.

The internal configuration of the body of the plug of the known locking device is of complex form, including a separate slot to receive each tumbler together with further separate slots each to receive a spring acting on the associated tumbler to urge it into its projecting position, each spring being disposed between a projection on the associated plunger and a staking bar.

With the present requirements for automatic assembly operations to reduce manufacturing costs, there is a demand for greater precision and a reduction of tolerance levels. These have not been achieved with the present methods of production in which the plug has been formed as a one-piece zinc-based die-casting, despite the use of complex and expensive tooling constructions. It is accordingly an object of the invention to provide an improved form of a plug for a locking device of the kind specified.

SUMMARY OF THE INVENTION

A plug for a locking device of the kind specified comprises an outer housing and an inner matrix, the outer housing being formed with slots to receive springs which act on the tumblers, the inner matrix being formed with slots to receive the tumblers and means being provided to lock the inner matrix within the outer housing.

The outer housing is preferably formed as a zinc-alloy die casting and the inner matrix may be formed either by die-casting using a zinc-based alloy or by moulding techniques using a synthetic plastics material such as a polyacetal resin. The inner matrix may be formed as one piece or, particularly when moulded from a synthetic plastics material, may be formed as two pieces which are snap-fitted together, care being taken to ensure the complete absence of flash or any other projecting fin formations from the inner matrix.

The means for locking the inner matrix within the outer housing may comprise one of the staking bars normally used as abutment members for the springs which act on the tumblers, the staking bar engaging lugs on the inner matrix and the lugs being disposed between alternate springs. The inner matrix may also be provided with end tabs.

BRIEF DESCRIPTION OF THE DRAWINGS

FIG. 1 is a transverse sectional view of an assembled plug,

FIG. 2 is a plan view of the outer housing of the plug,

FIG. 3 is a plan view of the inner matrix of the plug, and

FIG. 4 is an end view of the inner matrix.

DESCRIPTION OF THE PREFERRED EMBODIMENT

As shown in the drawings, the plug includes an outer housing 10 (shown in FIG. 2) and an inner matrix 11 (shown in FIGS. 3 and 4), which are assembled as indicated in FIG. 1. The housing 10 has a central through aperture 12 of rectangular form in plan which is provided in opposite side walls thereof with spring-receiving slots 13. There are five slots 13A in side wall 14 of the housing, these slots 13A being open at their upper ends and closed at their lower ends by inwardly directed integral formations 15. There are also five slots 13B in side wall 16 of the housing, these slots 13B being open at their lower ends and closed at their upper ends. Springs 17A are disposed in slots 13A and springs 17B are disposed in slots 13B.

The inner matrix 11 is formed with two rows of four slots 18A and 18B, the slots 18A being disposed in register with the slots 13A and the slots 18B being disposed in register with the slots 13B. The inner matrix 11 also has end tabs 19 and 20 which engage as close sliding fits in appropriately positioned channels 21 and 22 in the end walls 23 and 24 of the housing 10. The end face of the inner matrix 11 adjacent end tab 20 is provided with rebates 25A and 25B of dimensions corresponding to the slots 18A and 18B.

An axial key slot 26 is formed in the inner matrix 11 and the opposite side walls of this slot 26 are provided with inward projections 27 and 28 which ensure that only a key of the required cross-sectional configuration can be inserted in the slot. As the key (not shown) is moved along the slot 26, the upper and lower edges of the key engage limbs 29A and 30A of tumblers 31A and 32A, the tumblers 31A being displaced in the slots 18A and the tumblers 32A being displaced in the slots 18B. In addition, or course, one tumbler 31A is located in rebate 25A and one tumbler 32A is located in rebate 25B. As shown in FIG. 1, the tumblers 31A and 32A are of somewhat L-shape but have projections 33 which extend into the slots 13A and 13B provided in the outer housing 10, the projections 33 being acted on by the springs 17A and 17B located in said slots 13A and 13B. Thus, as shown in FIG. 1, the tumblers 31A and 32A are normally biased into positions in which end portions thereof project outwardly of the housing 10 for locking engagement with corresponding formations of the lock cylinder (not shown). Rotation of the plug within the cylinder is thus normally prevented. However, when the correct key is inserted in the key slot 26, movement of the tumblers 31A and 32A against the action of the springs 17A and 17B is effected to move the tumblers into their retracted positions.

As shown in FIGS. 3 and 4, the inner matrix 11 is provided with four spaced lugs 34 and these lugs 34 are arranged to fit within rebates 35 formed in the outer housing 10. As can be seen from FIG. 1, the lugs 34 are so positioned that, when the staking bar 36 which holds the springs 17A in position is inserted, the staking bar 36 serves to lock the lugs 34 in the rebates 35 thereby preventing separation of the inner matrix 11 from outer housing 10.

There are of course two staking bars, the other staking bar 37 serving to hold the springs 17B in position. After the staking bars 36 and 37 have been appropriately positioned, the material of the outer housing 10 is upset or deformed to provide inwardly extending tongues which act to prevent displacement of the staking bars 36 and 37.

As explained above, an important object of the invention is to facilitate assembly using automatic machinery for which it is necessary that the components should be produced within close tolerance ranges. The designs of the inner matrix 11 (which may be formed as two plastics mouldings which are snap-fitted together) and of the outer housing 10 (which is normally a zinc-based alloy die casting) enable this close tolerance range to be achieved.

The particular form of plug shown in the drawings is for use in a motor vehicle, for example as part of a steering column lock.

What is claimed is:

1. In a plug for a locking device intended, in use, to be turned by means of the appropriate key within a cylinder, the plug having tumblers which normally project therefrom for engagement with the cylinder to prevent rotation of the plug relative to the cylinder but are retracted into the key plug by the key upon insertion of the key, the improvement which comprises forming the plug as an outer housing and an inner matrix, the outer housing having slots to receive springs which act on the tumblers, the inner matrix having slots to receive the tumblers and means being provided to lock the inner matrix within the outer housing.

2. A plug according to claim 1, wherein the outer housing is formed as a zinc-alloy die casting and the inner matrix is formed by die casting using a zinc-based alloy.

3. A plug according to claim 1, wherein staking bars serve as abutment members for springs which act on the tumblers and one of the staking bars forms part of the means for locking the inner matrix within the outer housing.

4. A plug according to claim 3, wherein such staking bar engages lugs on the inner matrix, the lugs being disposed between alternate springs.

5. A plug according to claim 3, wherein the inner matrix is provided with end tabs which engage within channels formed internally of the outer housing.

6. A plug according to claim 1, wherein the outer housing is formed as a zinc-alloy die casting and the inner matrix is formed as a two-part plastics moulding the two parts of which are snap-fitted together.

* * * * *